United States Patent [19]

Sasaki

[11] Patent Number: 4,561,457

[45] Date of Patent: Dec. 31, 1985

[54] COIN SORTER AND COUNTER

[75] Inventor: Tsutomu Sasaki, Yokohama, Japan

[73] Assignee: Billcon Co., Ltd., Kawasaki, Japan

[21] Appl. No.: 585,210

[22] Filed: Mar. 1, 1984

[51] Int. Cl.[4] ..... G07D 3/06

[52] U.S. Cl. ..... 133/3 G; 133/8 C

[58] Field of Search ..... 133/8 R, 8 C, 3 A, 3 E, 133/3 H, 3 B, 3 G; 221/169, 170; 209/679

[56] References Cited

U.S. PATENT DOCUMENTS 1,947,456 2/1934 Bock ..... 133/3 G

FOREIGN PATENT DOCUMENTS 1419609 12/1975 United Kingdom ..... 133/3 H

*Primary Examiner*—Stanley H. Tollberg
*Attorney, Agent, or Firm*—Bruce L. Birchard

[57] ABSTRACT

A coin sorter and counter comprising a sloped combination of a pick-up plate and a selecting plate rotating in unison and forming a sandwich with a separator, such separator having a window therein for permitting coins to pass, one-at-a-time, from the pick-up plate, through the separator, into one of a series of coin entrances along the periphery of the selecting plate, each such coin entrance leading into a boomerang-shaped, angulated coin selecting slot or guide which is tapered downwardly in size from its entrance to its terminus, the selecting plate passing over a selecting base in which there is a series of openings spaced angularly about the axis of rotation of the selecting plate, such openings being graduated in size to correspond to the diameter of coins to be sorted, the smaller the opening, the shorter the radial distance of that opening from the axis of rotation of the selecting plate, the direction of angulation of the coin-selecting slots being in the direction of rotation of the selecting plate.

10 Claims, 10 Drawing Figures

COIN SORTER AND COUNTER

BACKGROUND OF THE INVENTION

1. Field of the Invention

This invention relates to coin sorters and counters and more particularly to those of the rotating disk variety.

2. Prior Art

In the past, coin sorters, with their usually attendant coin counters, have fallen into two categories. First of all there have been rail sorters in which the coins being sorted roll along a rail until they find a slot which is of the appropriate diameter or width to permit passage of the coin and rotating disk sorters which, in the past, have been of the half-moon variety in which the coins are forced against a wall by centrifugal force and ultimately find the proper size opening corresponding to the coin's diameter and its denomination. These disk coin sorters have been generally of the type having a horizontal platform and rotating disk. Such prior art devices are bulky, space consuming and expensive to build. Furthermore, because of the spacing between the coin sorting and coin counting mechanisms, there is inaccuracy in the count which is registered. This is particularly true for small coins which may be stopped between the sorting gate and the counting mechanism and thus may be missed in the count.

Therefore, it is an object of this invention to overcome the problems of the prior art devices.

It is a further object of this invention to provide a coin sorter and counter which is compact, inexpensive to manufacture and accurate in its sorting and counting results.

SUMMARY OF THE INVENTION

A pick-up plate having coin pockets each with an appropriately sloped edge to prevent holding more than one coin in each pocket is rotated in unison with and concentrically with a selecting plate. The pick-up plate and rotating selecting plate form a sandwich with a separator which is fixed in position. The separator has a window positioned proximate to its periphery. The coin pockets in the pick-up plate align with the window during the course of the rotation of the pick-up plate, permitting each coin to pass, one-at-a-time, through the separator into one of a series of coin entrances along the periphery of the selecting plate. Each such entrance is coupled to a boomerang-shaped, angulated coin-selecting slot or guide which is tapered downward in size from the entrance to its terminus so that the smallest coin ends up closest to the axis of rotation of the rotatable selecting plate. The selecting base, which is fixed in position, has a series of openings therethrough spaced angularly about the axis of rotation of the rotatable elements, such openings being graduated in size to correspond to the diameters of coins to be sorted, the smaller the opening, the shorter the radial distance of its center from the axis of rotation. The direction of angulation of the coin-selecting pockets or guides is in the direction of rotation of the selecting plate so that the coins are slowed in their downward motion before entering the narrowed portion of the guides, thus preventing jamming of the coins in the pockets. As the pockets pass over the related-sized coin-selecting openings in the selecting base they are urged out of their respective pockets, through the appropriate opening and, through a connecting tube, to the appropriate container in the coin box. As the coin passes through the appropriate opening in the selecting base, it activates a mechanically-activated counter which is closely coupled to the respective opening in the selecting base. The result is a coin sorting and counting machine which is compact and accurate.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood by a reference to the following description taken in connection with the accompanying drawings, in which:

DETAILED DESCRIPTION OF THE PREFERRED EMBODIMENT

Figure 1:
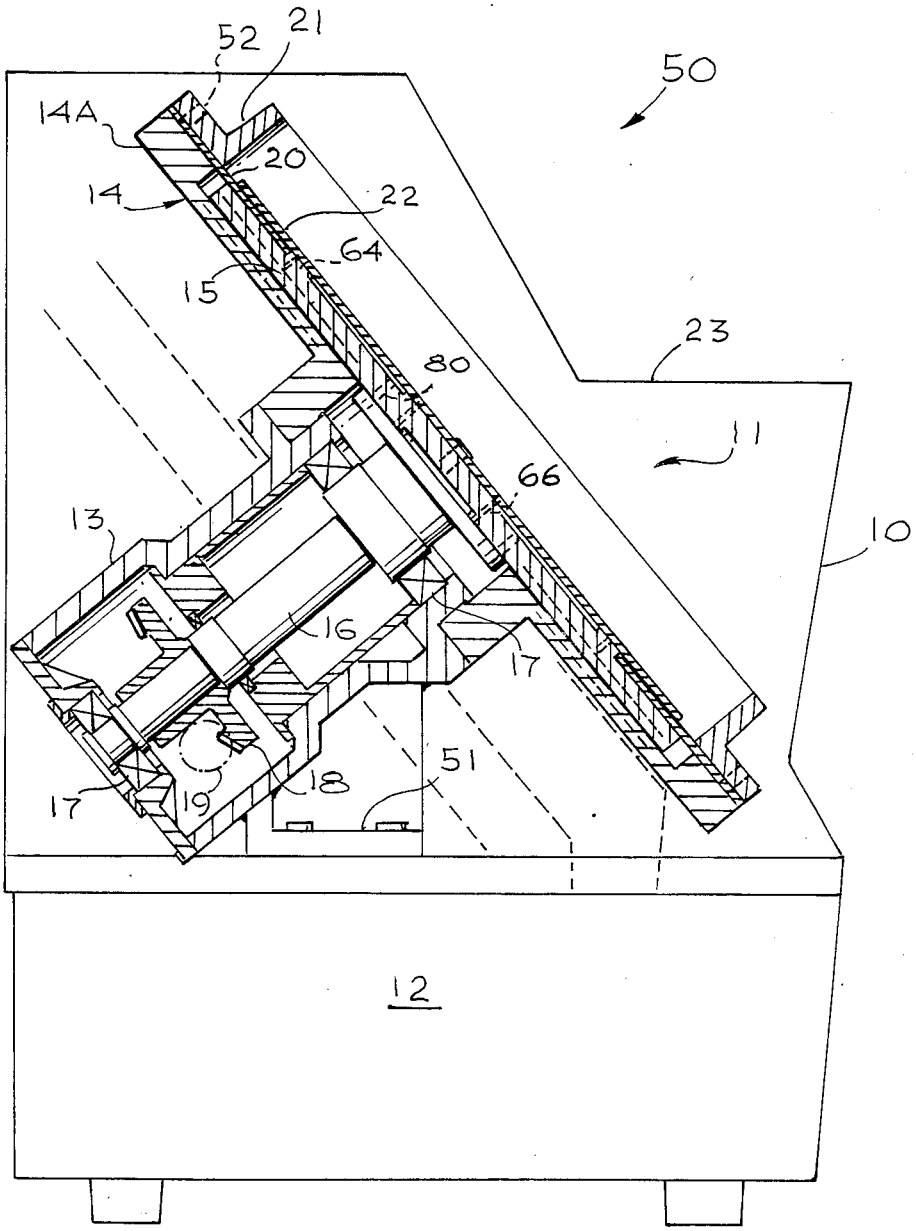
FIG. 1 is a side, elevational view, partially sectioned and partially in phantom lines, showing my invention.

In FIG. 1, coin sorter and counter 50 has a case 10 which is supported on a coin box and base 12 and which houses the coin sorting and counting mechanism 11. Coin sorter and counter 11 includes a main housing 13 which is supported through foot 51 on base 12. As can be seen from FIG. 1, housing 13 is neither horizontal nor vertical but its angle with the horizontal is approximately 45 degrees. Supported fixedly from housing 13 is selecting base 14 which is fixed with respect to housing 13. Supported within housing 13 is a shaft 16 which is designed to rotate within bearings 17 supported within housing 13. Shaft 16 is driven through the combination of pinion 19 and bevel gear 18 from a motor, not shown. Shaft 16 supports and, at one end, for rotation with shaft 16, selecting plate 15 and pick-up plate 22, which rotates in concert with selecting plate 15.

Selecting base 14 has a flange portion 14A around its periphery, the upper face of which supports separator 20 which is fixed in position by reason of its being sandwiched between flange 14A and circumferential wall 21.

Case 10 includes a coin input opening 23 which permits placing coins in a space formed by wall 21 and the surface of pick-up plate 22. The makeup and relationship of pick-up plate 22 and separator plate 20 can best be seen in FIG. 2.

Figure 2:
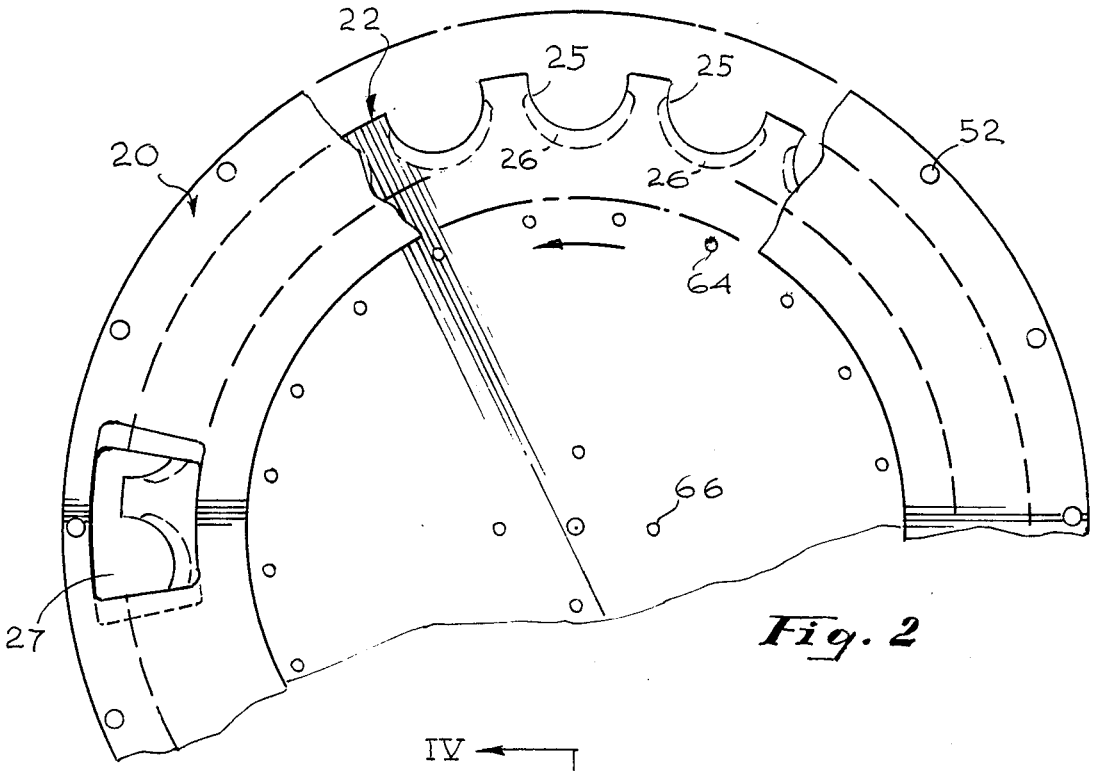
FIG. 2 is a bottom view of certain of the selector elements of FIG. 1.

In FIG. 2, separator plate 20 has openings 52, therein, for securing plate 20 to selecting base 14. Separator plate 20 also has window 27 therein for passage of coins from pick-up slots 25 in pick-up plate 22 into coin-selecting pockets which can be seen in FIG. 3 as element 29. As can be seen in FIG. 2 pick-up slots 25 have beveled edges the purpose of which is to make it easy for multiple coins to become disentangled by the upper coin sliding easily over the beveled portion 26 and back to the base or lower portion of the receptacle formed by wall 21 and pick-up plate 22.

Figure 3:
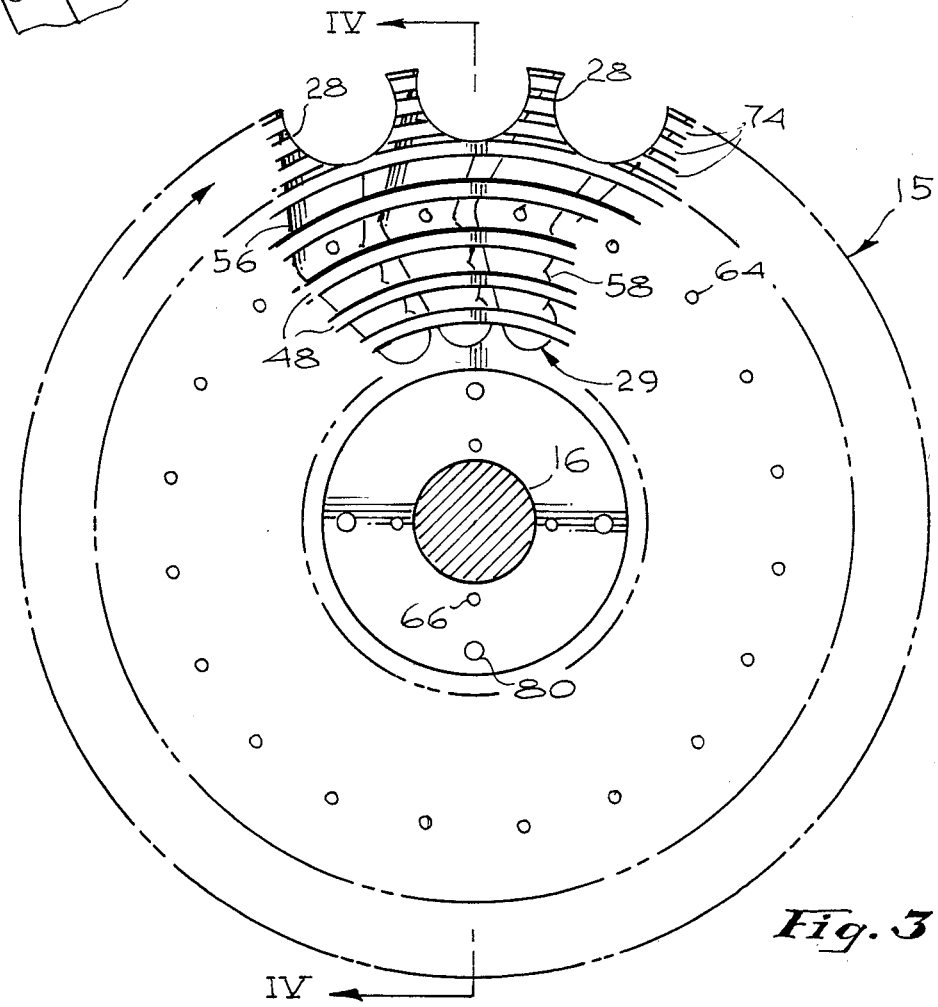
FIG. 3 is an elevational view of one of the rotating selecting elements of the sorter and counter of FIG. 1.

Turning to FIG. 3, rotatable selecting plate 15 has coin entrances 28 therein which are designed to pass under a window in 27 in separator plate 20. Coins falling into coin entrances 28 are introduced into coin pockets 29 which taper downwardly in width towards the center of plate 15. Further pockets 29 are angled at the lower end in the direction of rotation so that coins, as they fall into pockets 29 from entrances 28 strike edge 56 of the respective pockets and dissipate much of the downward energy and speed before being diverted into the portions of edge 58 more proximate to the shaft 16 driving selecting plate 15.

Figure 5:
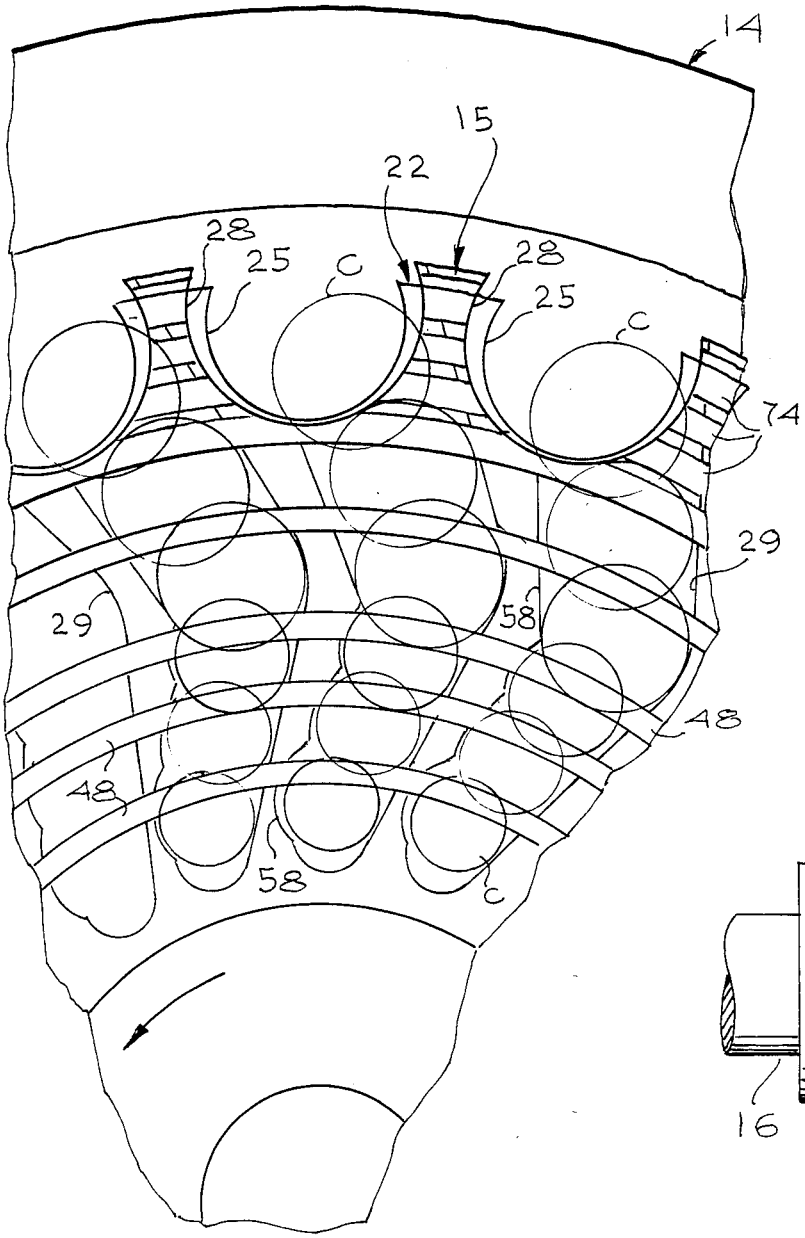
FIG. 5 is a schematic mechanical diagram showing coin positioning in certain of the coin sorting elements in the device of FIG. 1.

The sequence which may occur is seen more clearly in FIG. 5. Th figure shows the progress of various-sized coins towards the innermost portions of pockets 29. As can be seen in FIG. 5, the edge 58 of the pockets 29 may be shaped to accommodate the shape of the coins and to cause them to be more firmly seated. Grooves 48 in the lower side of the selecting disk 15 receive deflection arms 46 which protrude from base plate 14 and in the fashion and for the reasons described more fully in connection with FIG. 6.

Figure 6:
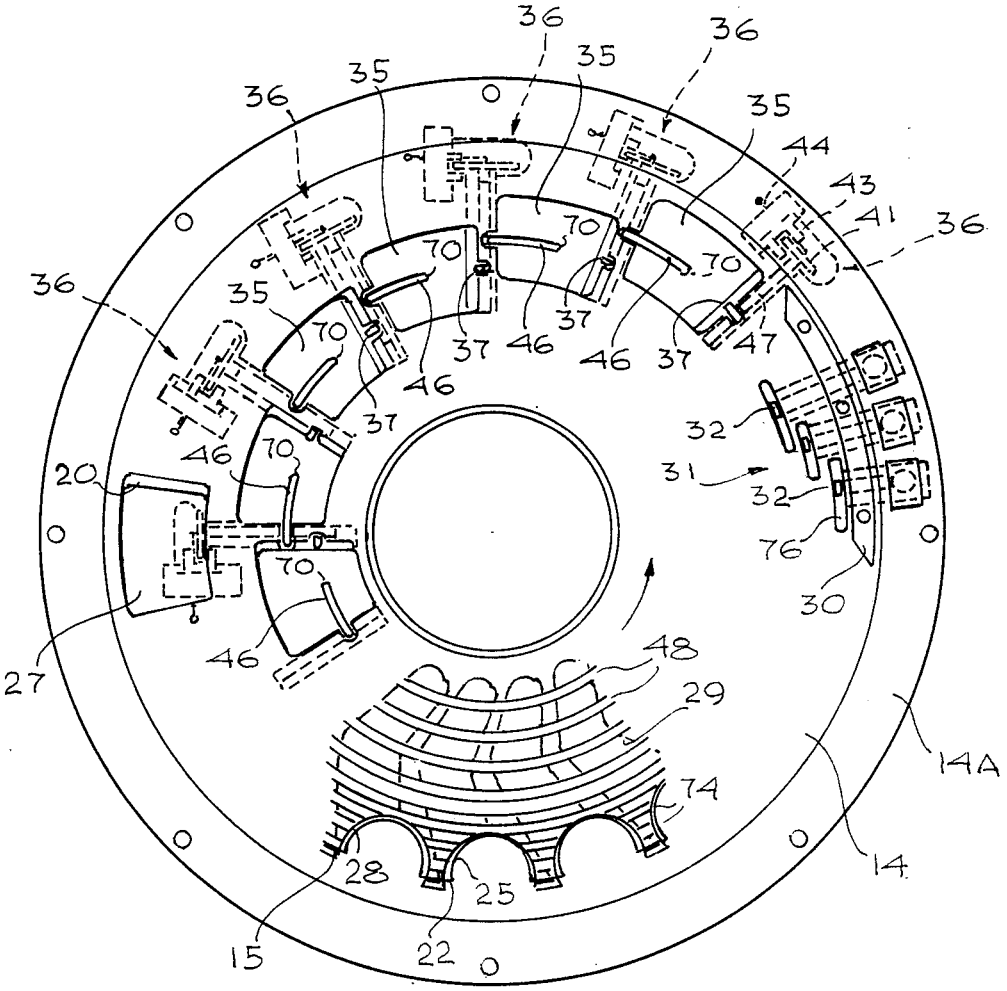
FIG. 6 is a bottom view of certain of the coin sorting and counting elements of the device in FIG. 1.

Circular groove 74 in the lower side of rotating selecting disk 15 are adapted to receive coin directors 32 which can be seen more clearly in FIG. 6.

In FIG. 5 the positions ultimately achieved by various sizes of coins as they move into boomerang-shaped guides or pockets 29 can be seen schematically in FIG. 5.

In FIG. 6 coin director arms 32 which are part of the overall coin guide system 31 are supported from the under-side of selecting base 14 in the region of flange 14A. The director arms 32 are supported in spring-biased fashion and protrude through openings 76 in base 14 and, in the absence of a coin, ride in groove 74 in the lower side of rotating selecting disk 15.

Figure 4:
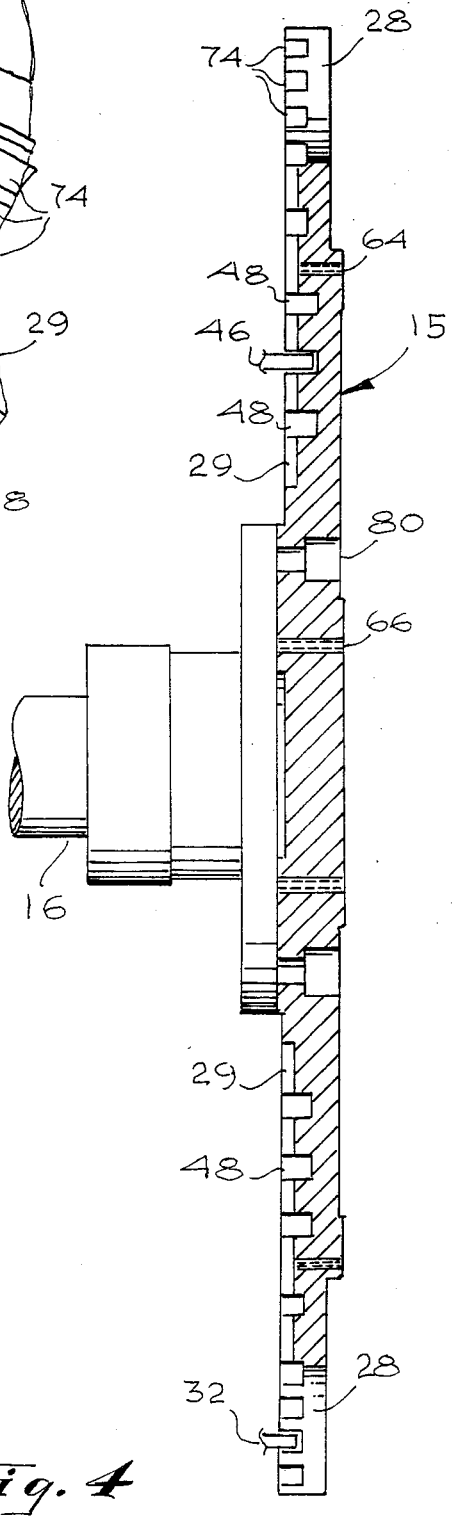
FIG. 4 is a cross-sectional view taken along the line IV—IV in FIG. 3.
Figure 6A:
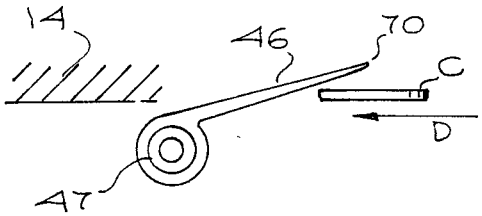
FIG. 6A is a schematic diagram showing the method of operation of a portion of the coin sorting apparatus of FIG. 6.

Cam element 30 gives the initial deflection of any coin towards the axis of rotation of rotating selecting disk 15. The initial deflection by cam surface 30 is augmented by director elements 32 so that each coin is urged into the innermost portion of its respective boomerang-shaped coin pocket. If the coin has reached the innermost point to which it can travel in the pocket and is firmly engaging the sides 58 of pockets 29 and is still, during rotation, sufficiently large so that it will engage any of the director elements 32, it will over-ride the spring-bias on the appropriate element 32 and cause element 32 to bend backward so that the coin in question may pass. The purpose, then, of cam surface 32 and of director element group 31 is to urge each coin to the innermost point it can reach in its respective boomerang-shaped coin pocket. Thus, each coin is aligned with an appropriate one of the sorting windows 35 and, as sorting disk 15 continues to rotate in the counter-clockwise direction shown in FIG. 6 and first actuates counting lever arm 37 and then deflecting arm 46 which deflects the coin through appropriate window 35 and its associated chute, if any, so that the coin ultimately falls in the appropriate portion of coin box 12, seen in FIG. 1. FIG. 6A shows schematically the shape of deflecting arm 46 and the direction of motion of coin C. Tip 70 of deflecting arm 46 rides in one of the grooves 48 seen in FIG. 4.

Figure 7:
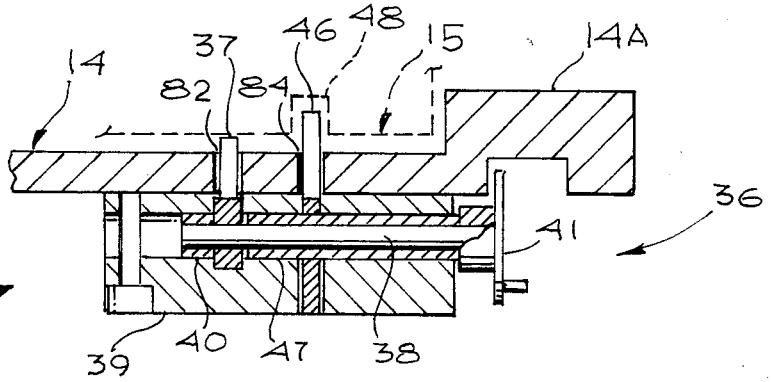
FIG. 7 is an elevational view, partially sectioned, of a portion of the coin counting mechanism of FIG. 1.
Figure 8:
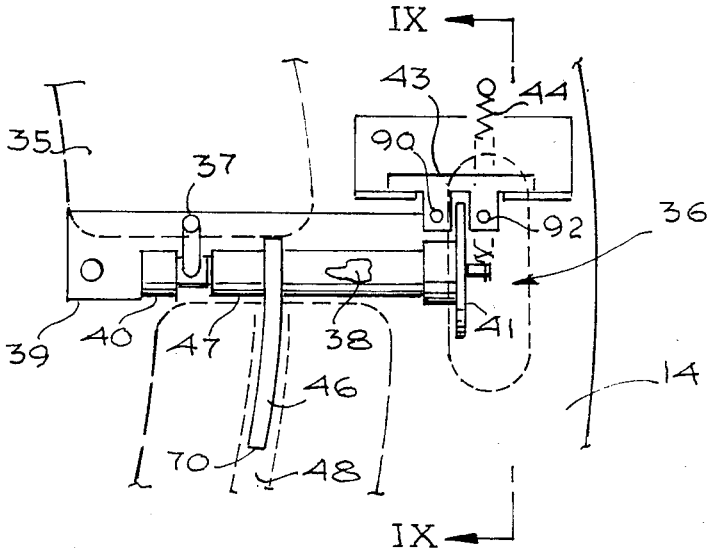
FIG. 8 is a plan view corresponding to the elevational view of the coin counter shown in FIG. 7; and, FIG. 9 is a view taken along the lines IX—IX in FIG. 8.
Figure 9:
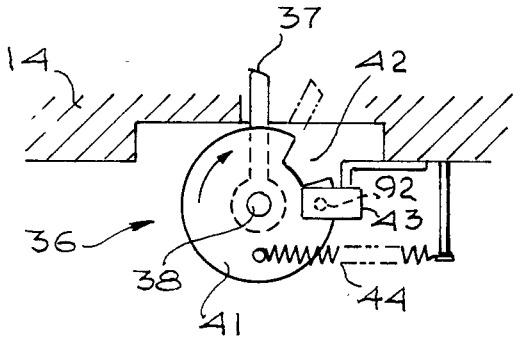

As has been indicated, element 37 is a counter-lever arm the operation of which can be seen more clearly in FIGS. 7–9.

The overall counting mechanism is designated 36 in FIGS. 6–9. Counter mechanism 36 is mounted on the underside of selector base 14 which has openings 82 and 84, therethrough, to permit passage of counter-lever arm 37 and deflection arm 46, respectively. Lever arm 37 is connected to shaft 38 which carries at one end thereof slotted disk 41 having a slot 42, therein. Shaft 38 is rotatably supported in journal 47. Rotation of lever arm 37 through an arc results in the rotation of slotted disk 41 through an equivalent arc. Slot sensor 43 which is carried in counter 36 may contain a light source 90 and a photo-diode 92 for example, the light path between which is normally broken by disk 41. However, when disk 41 is rotated in concert with lever arm 37, slot 42 permits light to pass from one element to the other in slot sensor 43 and a counting signal is developed. Spring 44 returns disk 41 to the position blocking the light path between the elements in slot sensor 43, when lever arm 37 is no longer deflected. The deflection of lever arm 37 results from the passage of a coin which is about to be dropped into its appropriate window 35 and discharged into the coin box 12.

Deflection arm 46 is supported from journal 47.

While a particular embodiment has been shown and described it will be evident to those skilled in the art that variations and modifications may be made therein without departing from the spirit and scope of this invention. It is the purpose of the appended claims to cover all such variations and modifications.

I claim:

1. A coin sorter and counter including:

a main housing;

a shaft rotatably carried in said main housing and adapted to be driven by a motor;

a coin pick-up plate secured to said shaft and rotatable therewith, said coin pick-up plate having a plurality of pick-up slots along the periphery of said pick-up plate;

a rotating coin selector plate secured to said shaft and rotatable in concert therewith and in concert with said pick-up plate, said rotating selector plate having a plurality of coin entrances along the periphery thereof;

said rotating selector plate having a plurality of coin pockets, each communicating with one of said coin entrances and each being tapered in width, with the greatest width being at the end thereof connected to said coin entrances, each of said coin pockets having a boomerang shape, with the narrow ends of the pockets being aimed generally in the direction of rotation of said rotating selector plate;

a separator base supported from said main housing;

a fixed separator plate supported from said separator base between said pick-up plate and said rotating selector plate, said fixed separator plate having a window therethrough spaced radially from the axis of said shaft a distance equal to the radial distance of said pick-up slots from the axis of said shaft for coincidence of respective ones of said pick-up slots and said window during rotation of said pick-up plate;

said separator base having a series of selector openings angularly spaced from each other at sequentially shorter radial distances from the axis of said shaft for selective passage of different sizes of coins; and, means for collecting the selectively passed coins.

2. Apparatus according to claim 1 which includes, in addition, counter means for counting each of the coins passed by each of said selector openings.

3. Apparatus according to claim 1 which includes, in addition, arm means for urging selected coins through their respective selector openings.

4. Apparatus according to claim 1 which includes, in addition, coin director means supported from said separator base in the line of travel of said coin pockets.

5. Apparatus according to claim 1 in which said coin pick-up plate, said rotating selector plate, said fixed separator plate and said separator base are parallel to each other and sloped with respect to vertical and horizontal reference axes.

6. Apparatus according to claim 3 in which said arm means normally ride in circular grooves in said rotating selector plate.

7. Apparatus according to claim 4 in which said coin director means includes a cam surface.

8. Apparatus according to claim 7 in which said coin director means includes, in addition, spring-biased coin directing arms at progressively shorter separations from the axis of the shaft, in the direction of rotation of said rotating selector plate.

9. Apparatus according to claim 1 in which said boomerang-shaped pockets each have one edge shaped to correspond to the shape of the coin being sorted.

10. A coin sorter and counter including:

a main housing;

a shaft rotatably carried in said main housing and adapted to be driven by a motor;

a coin pick-up plate secured to said shaft and rotatable therewith, said coin pick-up plate having a plurality of pick-up slots along the periphery of said pick-up plate;

a rotating coin selector plate secured to said shaft and rotatable in concert therewith and in concert with said pick-up plate, said rotating selector plate having a plurality of coin entrances along the periphery thereof;

said rotating selector plate having a plurality of coin pockets, each communicating with one of said coin entrances and each being tapered in width, with the greatest width being at the end thereof connected to said coin entrances, each of said coin pockets having a boomerang shape, with the pockets being bent in the direction of rotation of said rotating selector plate;

a separate base supported from said main housing;

a fixed separator plate supported from said separator base between said pick-up plate and said rotating selector plate, said fixed separator plate having a window therethrough spaced radially from the axis of said shaft a distance equal to the radial distance of said pick-up slots from the axis of said shaft for coincidence of respective ones of said pick-up slots and said window during rotation of said pick-up plate;

said separator base having a series of selector openings angularly spaced from each other at sequentially shorter radial distances from the axis of said shaft for selective passage of different sizes of coins;

means for collecting the selectively passed coins; and, counter means for counting each of the coins passed by each of said selector openings, said counter means including a lever arm, a slotted disk coupled to and rotated by said lever arm and a light source photo-diode combination into which said disk protrudes for breaking or opening, respectively, the light path between said light source and said photo-diode.

* * * * *